US006265927B1

(12) United States Patent
Lupia

(10) Patent No.: US 6,265,927 B1
(45) Date of Patent: Jul. 24, 2001

(54) ANTI-SATURATION INTEGRATOR AND METHOD

(75) Inventor: David J. Lupia, Largo, FL (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/434,704

(22) Filed: Nov. 5, 1999

(51) Int. Cl.[7] ..... G06G 7/64

(52) U.S. Cl. ..... 327/345; 327/336; 375/262

(58) Field of Search ..... 327/336, 341, 327/345, 362, 363, 91; 375/262

(56) References Cited

U.S. PATENT DOCUMENTS 5,173,924 * 12/1992 Hiraiwa et al. ..... 375/12
5,619,154 * 4/1997 Strolle et al. ..... 327/336
5,867,531 * 2/1999 Shiino et al. ..... 375/262

OTHER PUBLICATIONS

Andrew J. Viterbi, Senior Member, IEEE, Convolutional Codes and Their Performance In Communication Systems, IEEE Transactions on Communications Technology, vol. Com–19, No. 5, Oct. 1971, pp. 751–771.

Jerrold A. Heller, Member, IEEE, Irwin Mark Jacobs, Member, IEEE, Viterbi Decoding for Satellite and Space Communication, IEEE Transactions on Communications Technology, vol. Com–19, No. 5, Oct. 1971, pp. 835–848.

Bernard Sklar, *Digital Communications Fundamentals and Applications*, pp. 333–347.

* cited by examiner

*Primary Examiner*—Toan Tran
(74) *Attorney, Agent, or Firm*—Baker Botts L.L.P.

(57) ABSTRACT

A perfect integrator emulator includes a first multiplier multiplying an input with a first constant, $K_{NEW}$, and generating a scaled input, a summer summing the scaled input with a previously generated scaled output and generating an accumulated output, a delay adding a predetermined amount of delay to the accumulated output and generating a delayed output, a second multiplier multiplying the delayed output with a second constant, $K_{OLD}$, and generating the scaled output. The constants $K_{NEW}$ and $K_{OLD}$ are chosen such that the accumulated output emulates a perfect integrator's relative weighting, and saturation protection is guaranteed.

11 Claims, 2 Drawing Sheets

ANTI-SATURATION INTEGRATOR AND METHOD

TECHNICAL FIELD OF THE INVENTION

This invention is related in general to the field of digital signal processing, and more particularly, to an anti-saturation integrator and method.

BACKGROUND OF THE INVENTION

The Viterbi decoder or the Viterbi decoding algorithm are widely used for efficient coding in digital communication systems. The Viterbi decoder performs maximum likelihood decoding and involves calculating a measure of similarity or distance between the received signal and all the code trellis paths entering each state. The Viterbi algorithm removes trellis paths that are not likely to be candidates for the maximum likelihood choices. Therefore, the Viterbi aims to choose the code word with the maximum likelihood metric or stated another way, the code word with the minimum distance metric. The computation involves accumulating the distance metrics along a path using a perfect integrator.

Referring to FIG. 1, a Viterbi decoder circuit or algorithm portion 10 includes distance calculators 12-1, 12-2, to 12-N which compute the distance or difference of the received symbol from expected symbols 1 through N. The resultant computed distance from each calculator is then summed with the previous sum. The perfect integrator essentially implements an infinite accumulation for an infinite number of bits. Because a realistic implementation has a finite amount of memory and resources, the resultant accumulated sum inevitably overflows which is a condition know as saturation. When saturation occurs, the solution becomes corrupted and useless. Therefore, it is a requirement of every Viterbi decoder or decoding algorithm to protect against saturation.

Conventional anti-saturation solutions check each accumulated sum at each iteration (blocks 20-1, 20-2, and 20-N) to determine whether the accumulated sum is about to overflow. If yes, the metrics are scaled down by the same value to avoid saturation (blocks 26-1, 26-2, and 26-N). An alternative conventional method involves scaling or normalizing all metrics for every input symbol so that the most likely metric is always zero. Yet a third conventional method uses floating point implementation rather than fixed point implementation.

All the above-mentioned anti-saturation techniques suffer from several undesirable disadvantages. These conventional methods slow down the computation speed, use more hardware in the implementation, are more costly, and use more power to operate. Further, the floating point implementation is still at risk for saturation albeit at a decrease rate than the fixed point implementation.

SUMMARY OF THE INVENTION

It has been recognized that it is desirable to protect a Viterbi decoder or algorithm from overflow, since such anti-saturation conditions are inevitable in the normal course of operation and would lead to a corrupted output.

In one embodiment of the invention, a perfect integrator emulator includes a first multiplier for multiplying an input with a first constant, $K_{NEW}$, and generating a scaled input, a summer for summing the scaled input with a scaled previous output and generating an accumulated output, a delay adding a predetermined amount of delay to the accumulated output and generating a delayed output, a second multiplier for multiplying the delayed output with a second constant, $K_{OLD}$, and generating the scaled previous output. The constants $K_{NEW}$ and $K_{OLD}$ are chosen such that the accumulated output does not overflow and the integrity of the viterbi decode function is not compromised.

In another embodiment of the invention, a method for emulating a perfect integrator includes the steps of multiplying an input with a first constant, $K_{NEW}$, and generating a scaled input, summing the scaled input with a previously generated scaled output and generating an accumulated output, adding a predetermined amount of delay to the accumulated output and generating a delayed output, multiplying the delayed output with a second constant, $K_{OLD}$, and generating the scaled previous output, and whereby the constants $K_{NEW}$ and $K_{OLD}$ are chosen such that the accumulated output does not overflow and the integrity of the viterbi decode function is not compromised.

In yet another embodiment of the invention, an anti-saturation Viterbi decoder having an integrator that includes a first multiplier for multiplying a distance input with a first constant, $K_{NEW}$, and generating a scaled distance input, a summer for summing the scaled distance input with a scaled previous distance output and generating an accumulated distance output, a delay adding a predetermined amount of delay to the accumulated distance output and generating a delayed distance output, a second multiplier for multiplying the delayed distance output with a second constant, $K_{OLD}$, and generating the scaled previous distance output. The constants $K_{NEW}$ and $K_{OLD}$ are chosen such that the accumulated distance output does not overflow and the integrity of the viterbi decode function is not compromised.

BRIEF DESCRIPTION OF THE DRAWINGS

For a better understanding of the present invention, reference may be made to the accompanying drawings, in which.

DETAILED DESCRIPTION OF THE INVENTION

Figure 1:
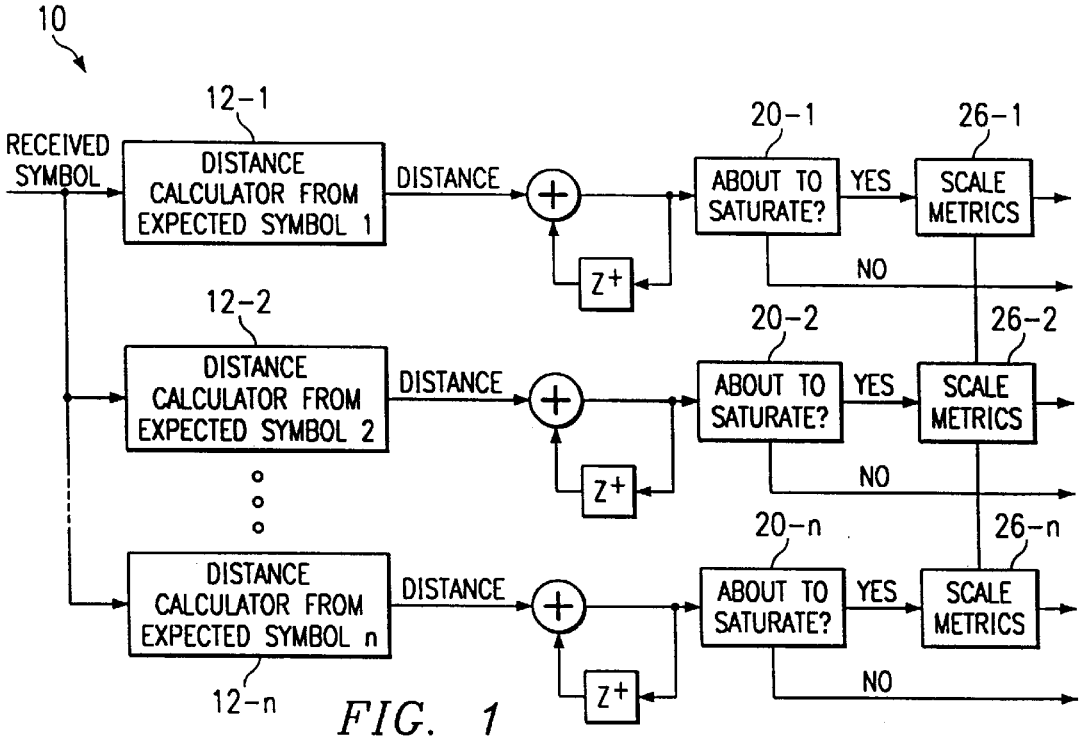
FIG. 1 (PRIOR ART)
FIG. 1 is a simplified block diagram of a conventional portion of a Viterbi decoder including an integrator used for matched distance decay accumulation.
Figure 2:
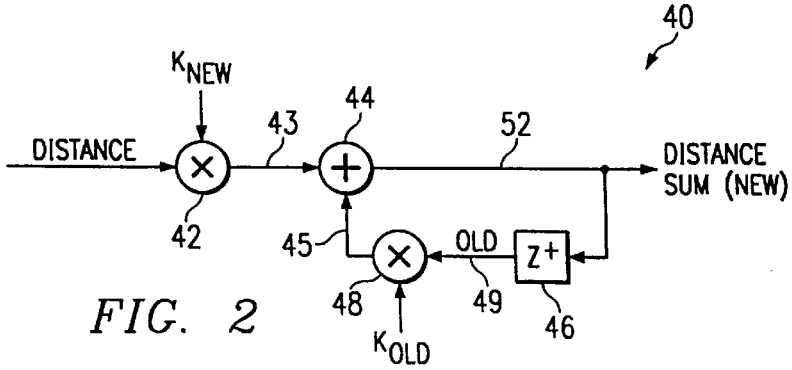
FIG. 2 is a block diagram of a perfect integrator emulator used for matched distance decay accumulation according to the teachings of the present invention.

FIG. 2 is a block diagram of a perfect integrator emulator 40 used for matched distance decay accumulation according to the teachings of the present invention. Perfect integrator emulator 40 strives to emulate the properties of a perfect integrator. Perfect integrator emulator 40 receives as input the distance calculated between the received symbol and an expected symbol. The distance input is first multiplied with a first predetermined scaling constant, $K_{NEW}$, by a first multiplier 42 and the resultant product is a scaled distance value 43, which is provided to a summer 42. Summer 42 sums scaled distance value 43 with a scaled old or previous distance value 45 from the output of a second multiplier 48. Second multiplier 48 multiplies a second predetermined scaling constant, $K_{OLD}$, with the previous distance 49 from the output of a delay circuit 46. The input to delay circuit 46 is the new distance or the accumulated distance 52.

According to the teachings of the present invention, the new distance sum may be computed by:

$$NEW[N] = \left(\frac{N}{N+1}\right)OLD + \left(\frac{1}{N+1}\right)DISTANCE$$

The constants (N/N+1) and (1/N+1) preferably describe the function of the perfect integrator. The perfect integrator weighs the old and distance values for each successive iteration. The weighting of each component may be described individually:

$$OLD[N] = \left(\frac{N}{N+1}\right)OLD$$

$$DISTANCE[N] = \left(\frac{1}{N+1}\right)DISTANCE$$

Therefore the key to the distance decay anti-saturation function is that the $K_{NEW}$ and $K_{OLD}$ constants are selected such that the overall effect emulates a perfect integrator's relative weighting. It is shown below that the invention contemplates $K_{NEW}$=0.01 and $K_{OLD}$=0.99, which allows circuit 40 shown in FIG. 2 to emulate a perfect integrator. With carefully chosen scalar constant values such as $K_{NEW}$=0.01 and $K_{OLD}$=0.99, saturation will not occur and a perfect integrator's relative weighting is still emulated.

Figure 3:
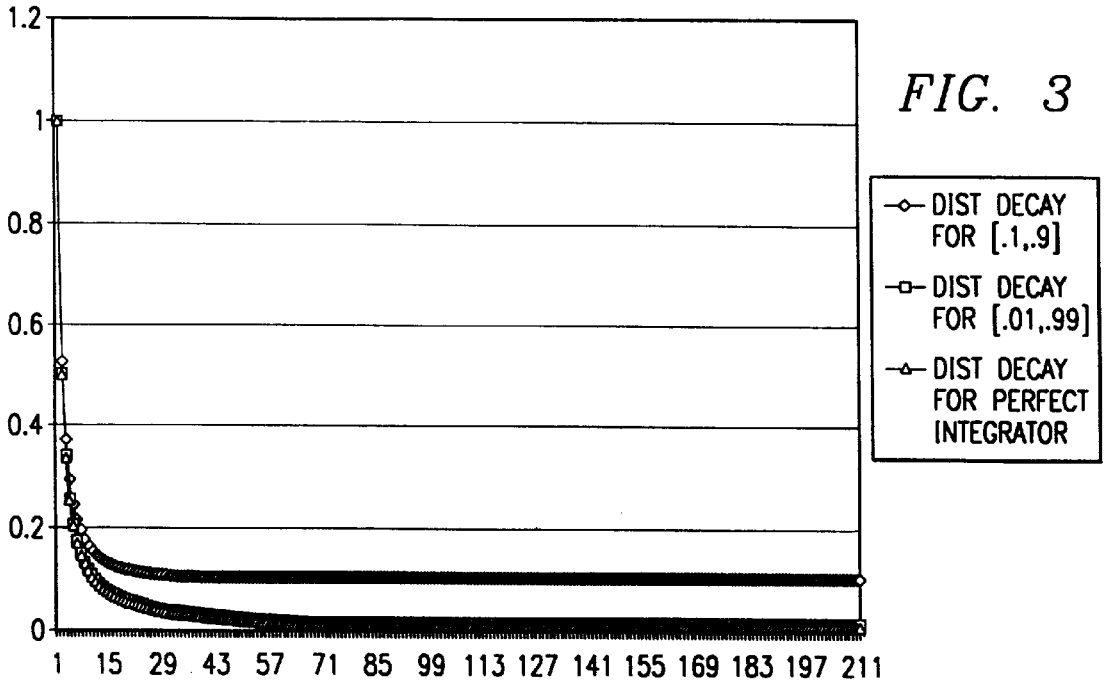
FIG. 3 is a distance delay plot comparing a perfect integrator with the perfect integrator emulator of the present invention using specific $K_{NEW}$ and $K_{OLD}$ values.

FIG. 3 is a distance decay plot comparing a perfect integrator with the emulated perfect integrator of the present invention using specific $K_{NEW}$ and $K_{OLD}$ values. It may be seen that with $K_{NEW}$=0.01 and $K_{OLD}$=0.99 (curve marked with □ symbol), circuit or algorithm 40 most closely emulates a perfect integrator (curve marked with Δ symbol). The third curve uses $K_{NEW}$=0.1 and $K_{OLD}$=0.9 (curve marked with ◇ symbol), which yields an undesirable result far different from the perfect integrator.

Figure 4:
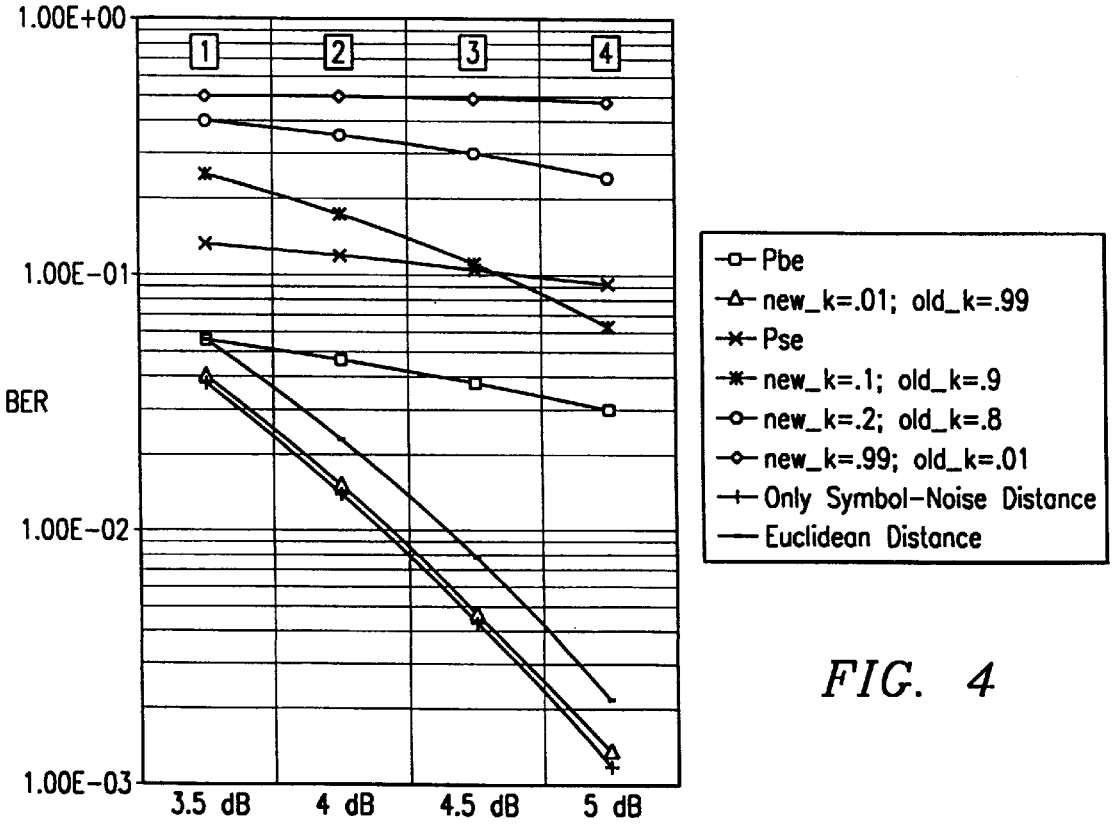
FIG. 4 is a theoretical bit rate error (BER) curve plot comparing a perfect integrator and emulated perfect integrator using various specific $K_{NEW}$ and $K_{OLD}$ values.

FIG. 4 is a theoretical bit rate error (BER) curve plot comparing a perfect integrator (curve marked with x) and integrators using various specific $K_{NEW}$ and $K_{OLD}$ values. This plot shows how significant degradation occurs for improperly chosen $K_{NEW}$ and $K_{OLD}$ constants. It may be seen that for $K_{NEW}$=0.01 and $K_{OLD}$=0.99 (curve marked with Δ symbol), with symbol-noise distance, there is very little degradation when compared with the perfect integrator's floating point implementation. However, for constant pairs ($K_{NEW}$,$K_{OLD}$)=(0.1, 0.9), (0.2, 0.8), and (0.99, 0.01) (curves with *, ●, and ◆ respectively), very significant degradation is observed. Degradation at this scale indicates a virtually non-functioning Viterbi decoder and algorithm.

The foregoing illustrates the importance that $K_{NEW}$ and $K_{OLD}$ constants be carefully selected such that the effect on the distance decay emulates the perfect integrator's distance decay curve. Employing the present invention, a Viterbi decoder or algorithm is now protected from saturation.

Although several embodiments of the present invention and its advantages have been described in detail, it should be understood that mutations, changes, substitutions, transformations, modifications, variations, and alterations can be made therein without departing from the teachings of the present invention, the spirit and scope of the invention being set forth by the appended claims.

What is claimed is:

1. A perfect integrator emulator, comprising:

a first multiplier for multiplying an input with a first constant, $K_{NEW}$, and generating a scaled input;

a summer for summing the scaled input with a previously generated scaled output and generating an accumulated output;

a delay adding a predetermined amount of delay to the accumulated output and generating a delayed output;

a second multiplier for multiplying the delayed output with a second constant, $K_{OLD}$, and generating the scaled output; and whereby the constants $K_{NEW}$ and $K_{OLD}$ are chosen such that the accumulated output does not overflow or underflow.

2. The perfect integrator emulator, as set forth in claim 1, wherein $K_{NEW}$ is 0.01 and $K_{OLD}$ is 0.99.

3. The perfect integrator emulator, as set forth in claim 1, wherein the input represents a difference between the value of a signal and the value of an expected signal.

4. The perfect integrator emulator, as set forth in claim 1, wherein the accumulated output represents an accumulated distance metric employed in a Viterbi decoder.

5. A method for emulating a perfect integrator, comprising:

multiplying an input with a first constant, $K_{NEW}$, and generating a scaled input;

summing the scaled input with a previously generated scaled output and generating an accumulated output;

adding a predetermined amount of delay to the accumulated output and generating a delayed output;

multiplying the delayed output with a second constant, $K_{OLD}$, and generating the scaled output; and whereby the constants $K_{NEW}$ and $K_{OLD}$ are chosen such that the accumulated output does not overflow or underflow.

6. The method, as set forth in claim 5, wherein the multiplying comprises utilizing $K_{NEW}$ equal to 0.01 and $K_{OLD}$ equal to 0.99.

7. The method, as set forth in claim 5, wherein multiplying the input comprises multiplying a difference between the value of a signal and the value of an expected signal with the first constant $K_{NEW}$.

8. The method, as set forth in claim 5, wherein summing the scaled input with a previously generated scaled output comprises accumulating a distance metric employed in a Viterbi decoder.

9. An anti-saturation Viterbi decoder, comprising:

a first multiplier for multiplying a distance input with a first constant, $K_{NEW}$, and generating a scaled distance input;

a summer for summing the scaled distance input with a previously generated scaled distance output and generating an accumulated distance output;

a delay adding a predetermined amount of delay to the accumulated distance output and generating a delayed distance output;

a second multiplier for multiplying the delayed distance output with a second constant, $K_{OLD}$, and generating the scaled previous distance output; and whereby the constants $K_{NEW}$ and $K_{OLD}$ are chosen such that the accumulated distance output does not overflow or underflow.

10. The Viterbi decoder, as set forth in claim 9, wherein $K_{NEW}$ equals 0.01 and $K_{OLD}$ equals 0.99.

11. The Viterbi decoder, as set forth in claim 9, wherein the distance input represents a distance between the value of a signal and the value of an expected signal.

* * * * *